US005912647A

United States Patent [19]

Tsuru et al.

[11] Patent Number: 5,912,647

[45] **Date of Patent: *Jun. 15, 1999**

[54] ANTENNA UNIT

[75] Inventors: Teruhisa Tsuru; Harufumi Mandai; Toshifumi Oida, all of Nagaokakyo, Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/852,749

[22] Filed: May 7, 1997

Related U.S. Application Data

[63] Continuation of application No. 08/659,025, Jun. 4, 1996, abandoned, and a continuation of application No. 08/240, 113, May 9, 1994, abandoned.

[51] Int. Cl.[6] ..... H01Q 1/38

[52] U.S. Cl. ..... 343/700 MS; 343/846

[58] Field of Search ..... 343/702, 700 MS, 343/829, 830, 846, 749; H01Q 1/24, 1/38

[56] References Cited

U.S. PATENT DOCUMENTS

| | | | |
|---|---|---|---|
| 5,148,181 | 9/1992 | Yokoyama et al. | 343/702 |
| 5,164,737 | 11/1992 | Murray et al. | 343/702 |
| 5,184,143 | 2/1993 | Marko | 343/749 |
| 5,355,142 | 10/1994 | Marshall et al. | 343/700 MS |
| 5,367,311 | 11/1994 | Egashira et al. | 343/749 |
| 5,400,039 | 3/1995 | Araki et al. | 343/700 MS |
| 5,510,502 | 4/1996 | Tsuru et al. | 343/700 MS |

FOREIGN PATENT DOCUMENTS

| | | |
|---|---|---|
| 0246026 | 11/1987 | European Pat. Off. . |
| 2553586 | 4/1985 | France . |
| 2360216 | 12/1973 | Germany . |
| 2240219 | 7/1991 | United Kingdom . |

OTHER PUBLICATIONS

Patent Abstracts of Japan, vol. 11, No. 46 (E–479) (2493) Feb. 12, 1987 & JP–A–61 210 707 (Mitsubishi Electric) (Abstract).

K. Fujimoto, et al., Small Antennas, Research Studies Press Ltd., England, 1987.

I.J. Bahl, et al., Microstrip Antennas, Artech House, Inc. 1980.

*Primary Examiner*—Michael C. Wimer
*Attorney, Agent, or Firm*—Ostrolenk, Faber, Gerb & Soffen, LLP

[57] ABSTRACT

An antenna unit having a substrate and a radiator, including a metal plate, which is mounted on the substrate, the radiator being provided with a feed terminal, a ground terminal and an electrostatic capacitance connecting terminal extending toward the substrate, so that the radiator is fixed to the substrate through the feed terminal, the ground terminal and the electrostatic capacitance connecting terminal, and further a capacitance being connected between the capacitance connecting terminal and a ground potential.

11 Claims, 7 Drawing Sheets

ANTENNA UNIT

This is a continuation of application Ser. No. 08/659,025 filed on Jun. 4, 1996, abandoned and a continuation of Ser. No. 08/240,113, filed on May 9, 1994, abandoned.

BACKGROUND OF THE INVENTION

1. Field of the Invention

The present invention relates to an antenna unit which is formed by combining a radiator having low conductor loss and a printed circuit board with each other, and more particularly, it relates to an antenna unit which is suitably applied to a mobile communication device, for example.

2. Description of the Background Art

An antenna unit must have excellent characteristics such as high gain and low reflection loss, and further miniaturization is required for an antenna which is applied to a mobile communication device.

In general, an inverted-F antenna unit is known to be usable as a miniature antenna in a mobile communication device.

An example of such an inverted-F antenna is described in "Small Antennas" by F. Fujimoto, A. Henderson, K. Hirasawa and J. R. James, Research Studies Press Ltd., England.

An exemplary inverted-F antenna unit is now described with reference to FIG. 1. Referring to FIG. 1, an inverted-F antenna unit 1 has a ground plate 2 which is connected to an earth potential, and a radiating plate 3, consisting of a metal plate, which is arranged above the ground plate 2 in parallel with the same. The radiating plate 3 is adapted to radiate electric waves. A short pin 4 is integrally formed on the radiating plate 3, to extend from its side edge toward the ground plate 2. This short pin 4 is electrically connected to the ground plate 2. Thus, the radiating plate 3 is shorted with respect to the ground plate 2 by the short pin 4. The ground plate 2 is provided with a coaxial cable connecting part 2*a*, which is connected with a coaxial cable or a coaxial connector for feeding the radiating plate 3.

While FIG. 1 typically illustrates the inverted-F antenna unit, it is necessary to provide the coaxial connecting part 2*a* on a printed circuit board for forming the coaxial connector or cable connecting part 2*a* in order to form a ground electrode on the printed circuit board thereby structuring the aforementioned ground plate 2 in practice. Further, it is necessary to connect a coaxial connector or a coaxial cable to the coaxial connecting part 2*a* which is formed on the printed circuit board. Thus, the coaxial connector or the coaxial cable must inevitably project from a major surface of the printed circuit board which is opposite to that provided with the antenna unit 1, which seriously hinders further miniaturization of the antenna unit 1.

In the inverted-F antenna unit 1, further, its gain is varied with the size of the radiating plate 3. In other words, the gain of the inverted-F antenna unit 1 is reduced as the size of the radiating plate 3 is reduced. When the radiating plate 3 is sized to be not more than about 1/10 of the wavelength of its resonance frequency in the inverted-F antenna unit 1 which is applied to a mobile communication device, it is impossible to attain a sufficient gain. In other words, it is extremely difficult to implement a miniature antenna unit having a high gain with the conventional inverted-F antenna unit 1.

SUMMARY OF THE INVENTION

An object of the present invention is to provide an antenna unit which can attain a high gain with a small size, and is easy to mount.

According to a broad aspect of the present invention, provided is an antenna unit comprising a substrate, a radiator, consisting of a material having a low conductor loss, which is mounted on the substrate and provided with a flat plate type radiating part as well as a feed terminal, a ground terminal and an electrostatic capacitance connecting terminal extending from side edges of the radiating part toward the substrate to be mounted on the substrate, and a capacitor which is connected between the capacitance connecting terminal and a ground potential.

In other words, the inventive antenna unit is structured with the radiator mounted on the substrate. The feed terminal, the ground terminal and the electrostatic capacitance connecting terminal of the radiator are mounted on the substrate, thereby mounting the radiator on the substrate. When the substrate is formed by a printed circuit board, which is generally employed for mounting an antenna unit, therefore, the feed terminal, the ground terminal and the electrostatic capacitance connecting terminal can be mounted by means of electrodes provided on the printed circuit board or holes formed in the printed circuit board. In other words, the antenna unit is not fed through a coaxial connector or a coaxial cable. Thus, it is possible to form the inventive antenna unit utilizing any type of printed circuit board as the aforementioned substrate, whereby the structure for mounting the antenna unit can be simplified.

In the antenna unit according to the present invention, further, the capacitor is connected between the radiating part and the ground potential through the capacitance connecting terminal. Electrostatic capacitance developed by this capacitor is inserted in series with distributed inductance of the radiating part, whereby the resonance frequency of the antenna unit is reduced by the capacitor. Thus, it is possible to provide a further miniaturized antenna unit having a high gain.

In addition, the feed terminal and the ground terminal extend from the side edge of the radiating part toward the substrate so that the distributed inductance value of a portion which is connected from the radiating part to the ground potential through the ground terminal can be adjusted by adjusting the distance between the feed terminal and the ground terminal. Thus, it is possible to easily match the impedance of the overall antenna unit with that of a peripheral circuit.

According to the present invention, the capacitor which is connected to the capacitance connecting terminal can be formed in various modes. For example, it is possible to form the capacitor by employing at least a partial layer of the substrate as a dielectric layer. Such a structure can be implemented by forming a capacitance deriving electrode on one major surface of the substrate while forming a ground electrode on another major surface to be opposed to the capacitance deriving electrode, or forming within the substrate at least one of a capacitance deriving electrode and a ground electrode, which is arranged to be opposed to the capacitance deriving electrode through a partial layer of the substrate, for example.

Alternatively, the capacitor can be formed by a capacitor element which is mounted on the substrate. Further, it is also possible to form the capacitor by a structure of interposing a dielectric layer between a pair of electrodes which are formed on the substrate.

As hereinabove described, it is possible to form the capacitor which is connected to the capacitance connecting terminal in various modes, which can be properly selected in response to the capacitance value required for the capacitor connected to the radiator in the inventive antenna unit.

However, the aforementioned capacitor which is formed by employing at least a partial layer of the substrate as a dielectric layer is preferable and there is no need to prepare a capacitor element as an independent component in this case. Namely, an operation of preparing a capacitor element as an independent component and mounting the same on the substrate can be omitted to simplify the mounting operation.

In a specific aspect of the present invention, the aforementioned substrate has a plurality of terminal insertion holes, so that the feed terminal, the ground terminal and the capacitance connecting terminal are inserted in the terminal insertion holes respectively to fix the radiator to the substrate.

According to another specific aspect of the present invention, a feed electrode, a ground electrode and an electrode land are formed on the aforementioned substrate, while the feed terminal, the ground terminal and the capacitance connecting terminal of the radiator have bonding portions which are bent in parallel with the substrate on forward ends thereof respectively. The bonding portions of the feed terminal, the ground terminal and the capacitance connecting terminal are bonded to the feed electrode, the ground electrode and the electrode land which are formed on the substrate respectively.

While the radiator according to the present invention can be fixed to the substrate in various modes as hereinabove described, the substrate does not have to be provided with a coaxial connecting part for feeding, and it is therefore possible to implement a mounting structure for the antenna with no requirement for a coaxial connector or a coaxial cable.

The material having low conductor loss for forming the radiator can be prepared from a metal material such as copper or a copper alloy, for example, but this material is not particularly restricted as long as the material has a low conductor loss which is similar to that of the above-mentioned metal material.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
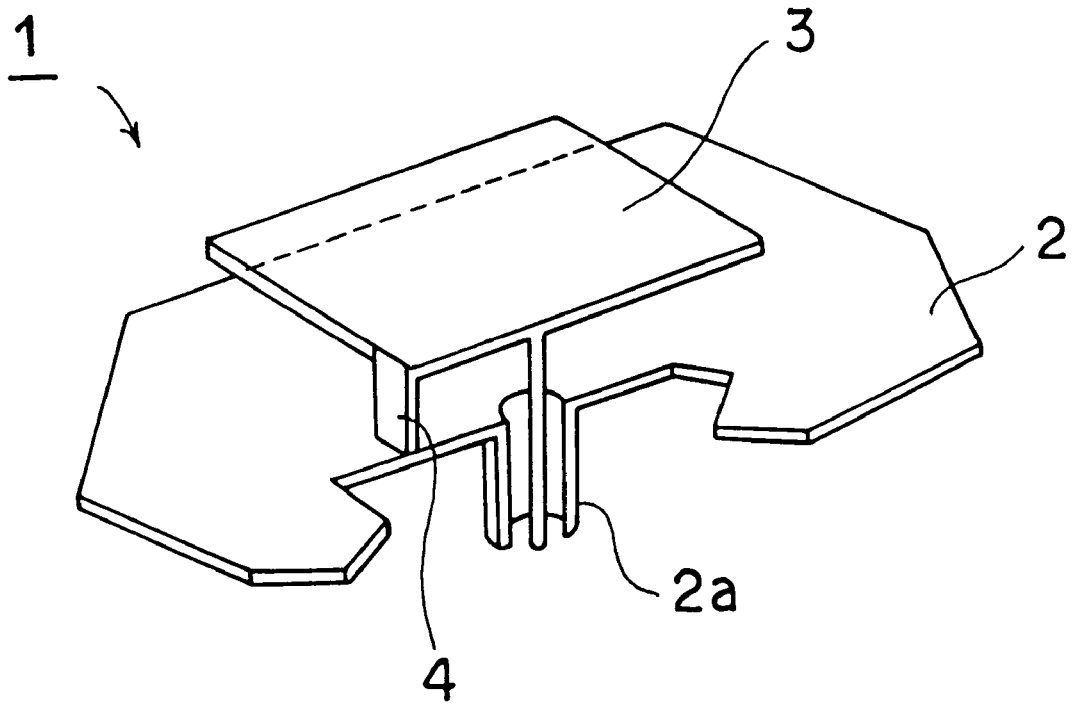
FIG. 1 PRIOR ART
FIG. 1 is a typical partially fragmented perspective view for illustrating a conventional inverted-F antenna unit.
Figure 2:
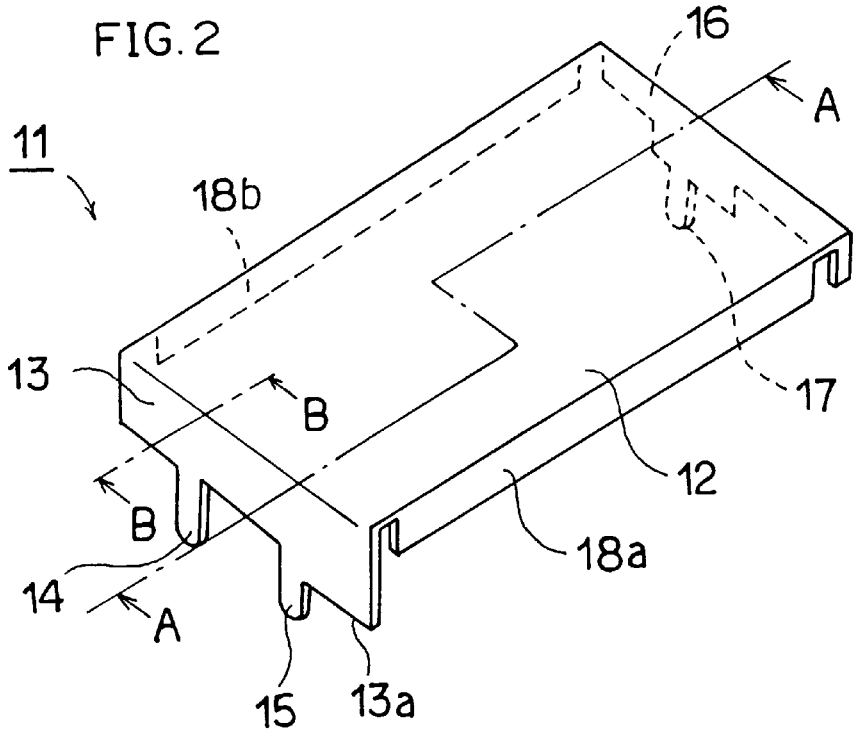
FIG. 2 is a perspective view showing a radiator which is employed for an antenna unit according to a first embodiment of the present invention.
Figure 3A:
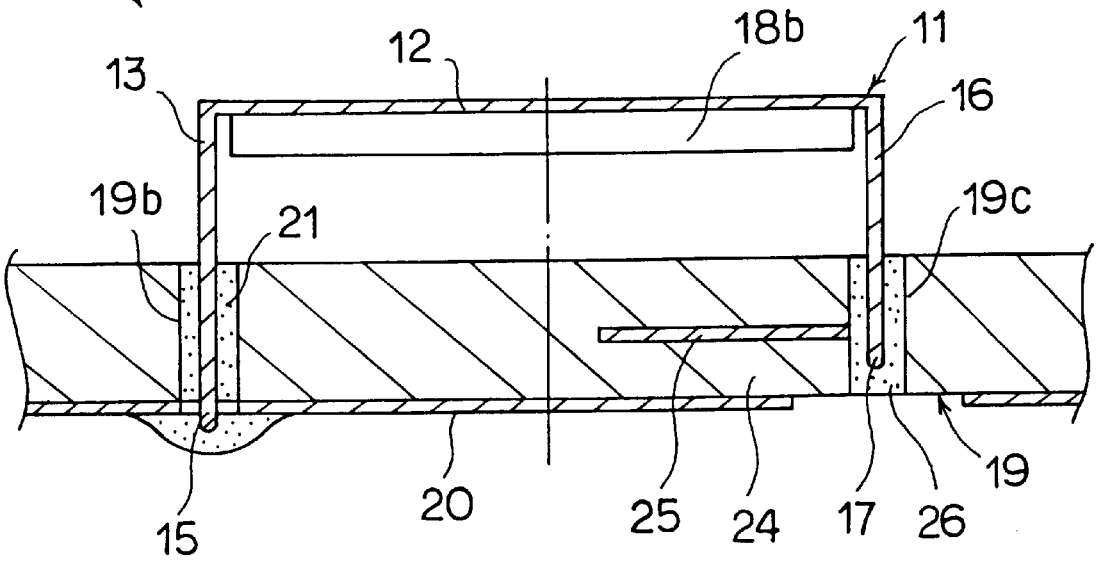
FIG. 3A is a step sectional view taken along a one-dot chain line A—A in FIG. 2, showing the antenna unit according to the present invention.
Figure 3B:
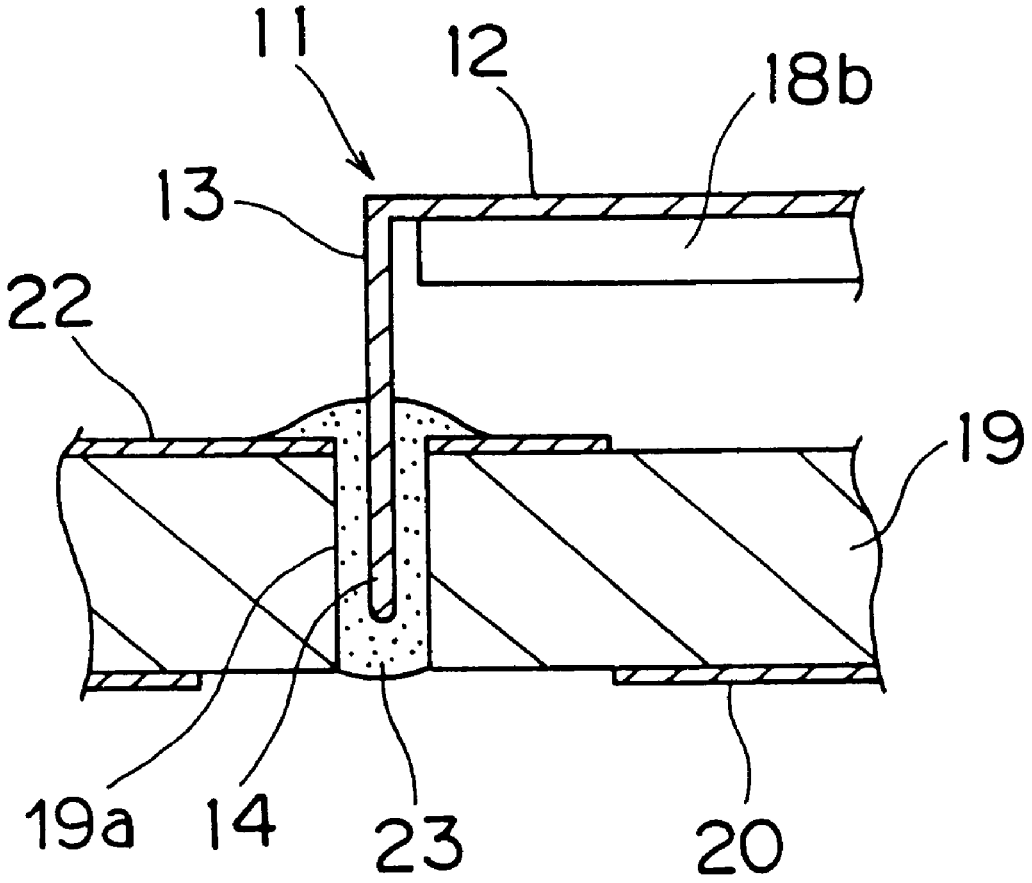
FIG. 3B is a sectional view taken along another one-dot chain line B—B in FIG. 2.

FIG. 2 is a perspective view showing a radiator 11 which is employed in an antenna unit 27 according to a first embodiment of the present invention, FIG. 3A is a step sectional view taken along the line A—A in FIG. 2 showing the antenna unit 27 according to the first embodiment, and FIG. 3B is a sectional view taken along the line B—B in FIG. 2.

Referring to FIG. 2, the radiator 11 is obtained by machining a metal plate of a metal material such as copper or a copper alloy into the shape as illustrated. This radiator 11 is provided with a radiating part 12 having a rectangular plane shape. The radiating part 12 is adapted to transmit/receive electric waves. One shorter side edge of the radiating part 12 is downwardly bent along its overall width to form a bent part 13. A narrow feed terminal 14 and a narrow ground terminal 15 are integrally formed on a forward end of the bent part 13. According to this embodiment, the feed terminal 14 and the ground terminal 15 are inserted in insertion holes of a printed circuit board as described later, whereby it is possible to decide the space between the radiating part 12 and an upper surface of the printed circuit board by deciding the position of a lower end 13*a* of the bent part 13.

The other opposite shorter side edge is also downwardly bent along its overall width to form a bent part 16. A narrow capacitance connecting terminal 17 is integrally formed on a forward end of the bent part 16.

Further, both longer side edges of the radiating part 12 are downwardly bent to form reinforcing members 18*a* and 18*b*. These reinforcing members 18*a* and 18*b* are adapted to improve mechanical strength of the radiator 11.

Referring to FIGS. 3A and 3B, the radiator 11 is mounted on a printed circuit board 19, through insertion holes 19*a* to 19*c* which are provided in the printed circuit board 19. In other words, the printed circuit board 19 is provided with the insertion hole 19*a* for receiving the feed terminal 14, the insertion hole 19*b* for receiving the ground terminal 15, and the insertion hole 19*c* for receiving the capacitance connecting terminal 17 respectively.

In mounting, the feed terminal 14, the ground terminal 15 and the capacitance connecting terminal 17 are inserted in the insertion holes 19*a*, 19*b* and 19*c* respectively, thereby positioning the radiator 11 on the printed circuit board 19 as shown in FIGS. 3A and 3B. In this case, this insertion is stopped at a position where the lower end 13*a* of the bent part 13 is in contact with the upper surface of the printed circuit board 19. As hereinabove described, therefore, it is possible to decide the depth of insertion of the ground terminal 15 and the distance between the radiating part 12 and the upper surface of the printed circuit board 19 by deciding the position of the lower end 13*a* of the bent part 13, i.e., the distance between the radiating part 12 and the lower end 13*a*.

A ground electrode 20 is formed on a lower surface of the printed circuit board 19. This ground electrode 20 is electrically connected to the ground terminal 15, which is inserted in the insertion hole 19*b*, by solder 21.

As shown in FIG. 3B, a feed electrode 22 is formed on the upper surface of the printed circuit board 19. This feed electrode 22 is electrically connected to the feed terminal 14, which is inserted in the insertion hole 19*a*, by solder 23. As clearly understood from FIG. 3A, on the other hand, a capacitance deriving electrode 25 is formed in the printed circuit board 19, to be opposed to the ground electrode 20 through a partial layer 24 of the printed circuit board 19. The capacitance deriving electrode 25 is formed to be exposed into the insertion hole 19*c*, and electrically connected to the capacitance connecting terminal 17 by solder 26 which is injected in the insertion hole 19*c*.

According to this embodiment, therefore, it is possible to form the antenna unit 27 by simply preparing the radiator 11 and the printed circuit board 19 and carrying out the aforementioned fixing operation. In other words, no coaxial connector or coaxial cable is employed and hence the lower surface of the printed circuit board 19 can be simplified in structure. Further, the mounting operation can also be easily carried out since the radiator 11 may simply be mounted on the printed circuit board 19 in the aforementioned manner.

Figure 4:
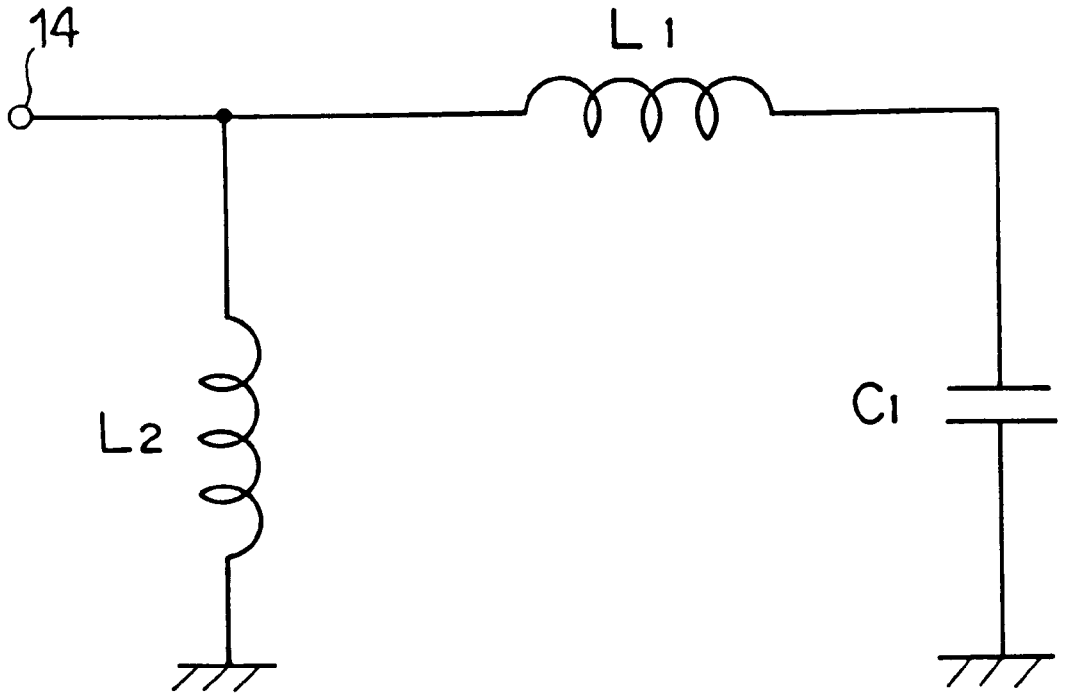
FIG. 4 shows an equivalent circuit of the antenna unit according to the first embodiment.

FIG. 4 shows an equivalent circuit of the antenna unit 27 according to this embodiment. Referring to FIG. 4, numeral 14 represents the feed terminal, symbol $L_1$ represents distributed inductance of the radiator 11, and symbol $L_2$ represents distributed inductance of a portion which is connected from the radiating part 12 to the ground electrode 20 of the printed circuit board 19 through the ground terminal 15. This distributed inductance $L_2$ can be adjusted by adjusting the distance between the feed terminal 14 and the ground terminal 15. Therefore, it is possible to adjust the ratio of the inductance $L_1$ to the inductance $L_2$ by adjusting the distance between the feed terminal 14 and the ground terminal 15, thereby easily attaining impedance matching with a peripheral circuit.

In the antenna unit 27 according to this embodiment, the capacitance deriving electrode 25 and the ground electrode 20 are stacked with each other through the substrate layer 24 which is a dielectric layer, to form a capacitor. Therefore, a capacitor $C_1$ shown in FIG. 4 is connected between the radiator 11 and an earth potential. Thus, the resonance frequency of the antenna unit 27 is reduced by the electrostatic capacitance of the capacitor $C_1$, whereby it is possible to form a further miniaturized antenna unit.

Figure 5:
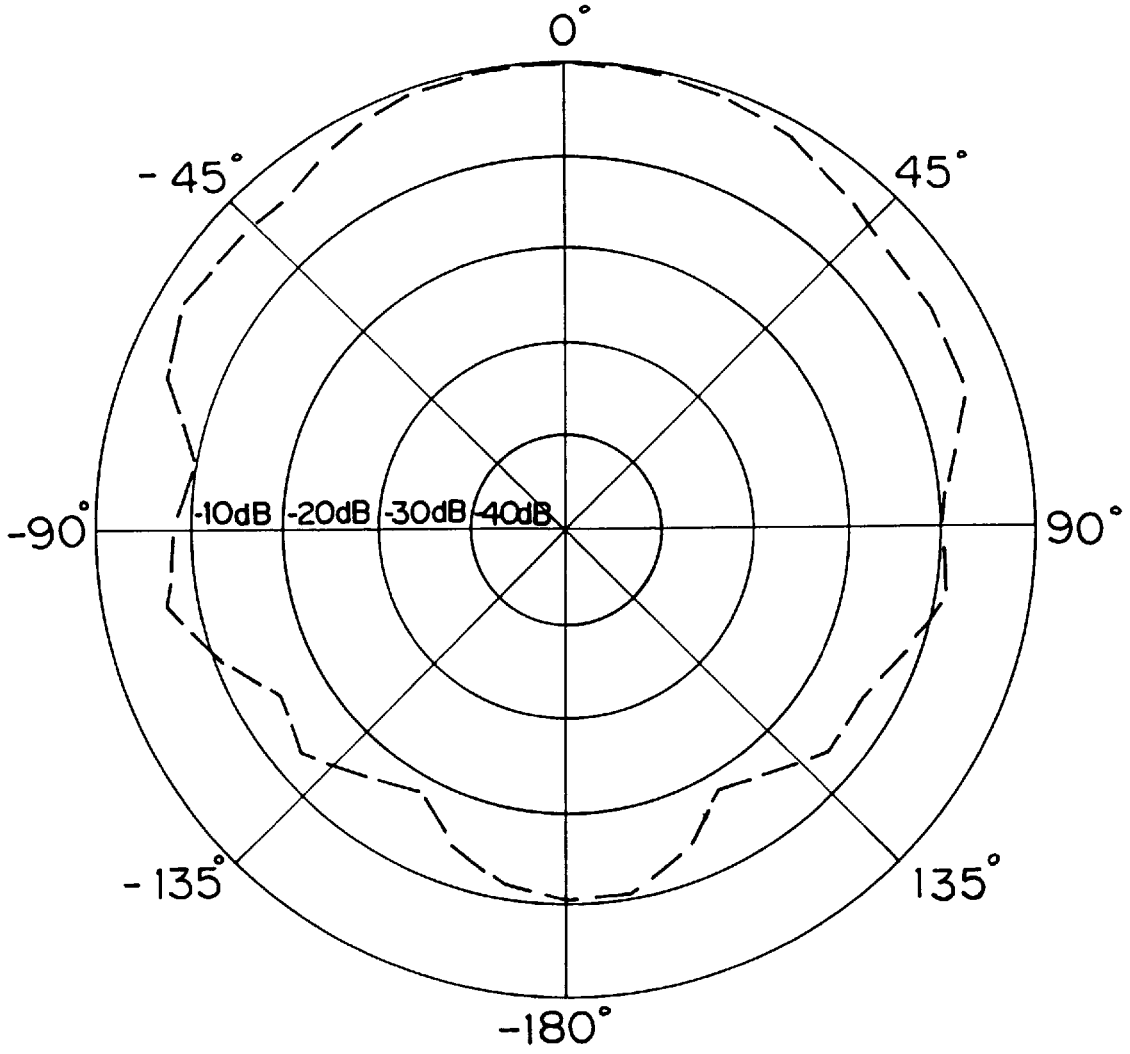
FIG. 5 illustrates a directional pattern of the antenna unit according to the first embodiment.

FIG. 5 shows a directional pattern of the antenna unit 27 according to this embodiment. The directional pattern shown in FIG. 5 is that of a sample of the antenna unit 27 having the radiating part 12 of 10 mm in length and 6.3 mm in width with a height of 4 mm between the radiating part 12 and the printed circuit board 19 shown in FIGS. 3A and 3B and a resonance frequency of 1.9 GHz. It is clearly understood from FIG. 5 that the maximum gain of −2 dB was attained in this sample, and hence it is possible to implement a substantially omnidirectional antenna unit. The aforementioned dimensions are about 1/16 of the wavelength of electric waves transmitted/received in the largest portion, and hence it is understood to be possible to remarkably reduce the overall dimensions as compared with the conventional inverted-F antenna unit.

Figure 6:
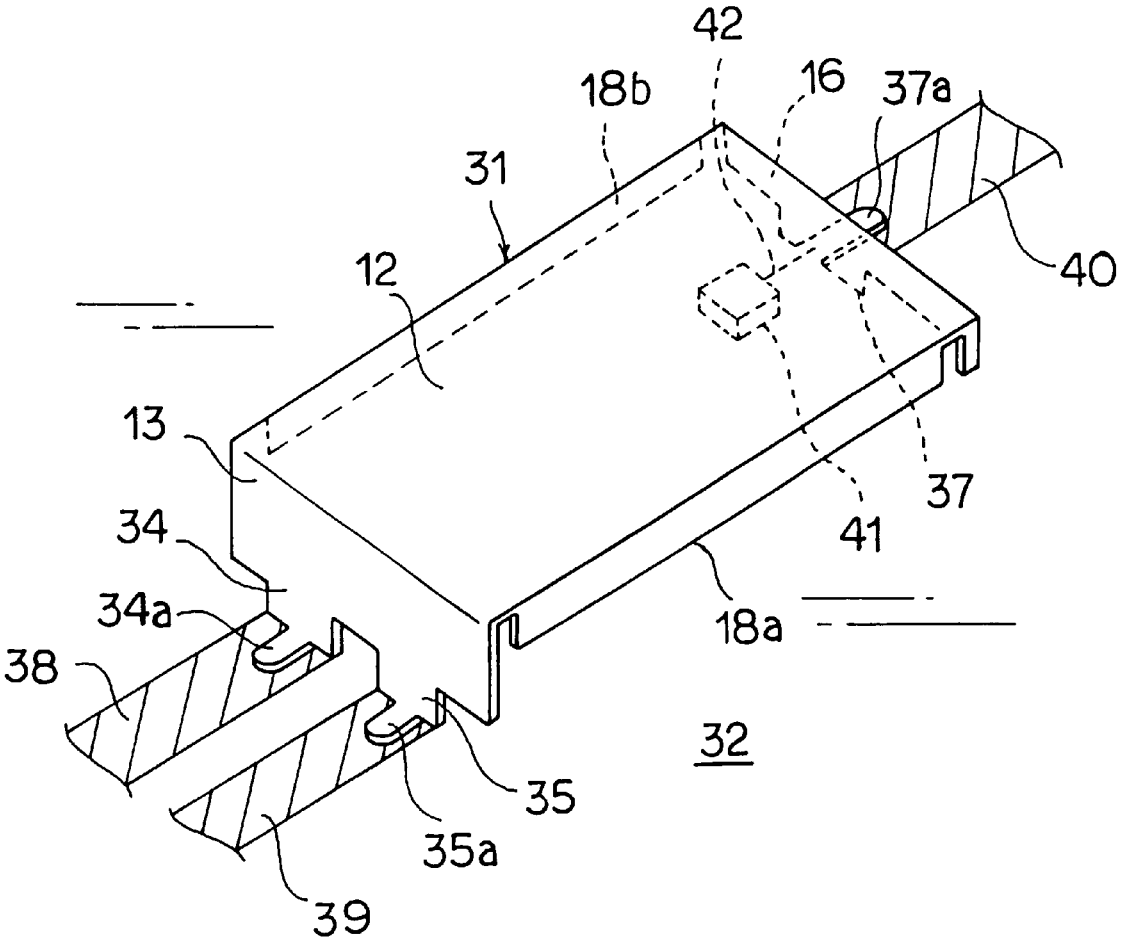
FIG. 6 is a perspective view for illustrating an antenna unit according to a second embodiment of the present invention.

FIG. 6 is a perspective view for illustrating an antenna unit according to a second embodiment of the present invention. The antenna unit according to the second embodiment has a radiator 31, which is substantially similar in structure to the radiator 11 employed for the antenna unit 27 according to the first embodiment. The radiator 31 is different from the radiator 11 in that forward ends of a feed terminal 34, a ground terminal 35 and a capacitance connecting terminal 37 which are integrally provided on bent parts 13 and 16 are bent in parallel with the substrate surface of a printed circuit board 32. As to other points, portions of the radiator 31 identical to those of the radiator 11 are denoted by the same reference numerals, to omit redundant description.

In the radiator 31, bonding parts 34*a* and 35*a* which are bent in parallel with the substrate surface of the printed circuit board 32 are formed on forward ends of the feed terminal 34 and the ground terminal 35 which are provided on the bent part 13. Similarly, a bonding part 37*a* which is bent in parallel with the substrate surface of the printed circuit board 32 is also formed on a forward end of the capacitance coupling terminal 37 which is provided on the bent part 16. While the bonding parts 34*a*, 35*a* and 37*a* are formed to outwardly extend from the radiator 31 as shown in FIG. 6, the same may alternatively be formed to inwardly extend into the radiator 31.

On the other hand, a feed electrode 38, a ground electrode 39 and an electrode land 40 are formed on an upper surface of the printed circuit board 32. The bonding parts 34*a*, 35*a* and 37*a* are bonded to the feed electrode 38, the ground electrode 39 and the electrode 40 respectively by solder. Thus, the radiator 31 is fixed to the printed circuit board 32, while the feed terminal 34 and the ground terminal 35 are electrically connected to the feed electrode 38 and the ground electrode 39 respectively.

Further, a chip-type capacitor 41 is surface-mounted on the upper surface of the printed circuit board 32 in the radiator 31. One electrode of the chip-type capacitor 41 is electrically connected to the capacitance connecting terminal 37 by an electric connecting part 42 schematically illustrated in FIG. 6. The electric connecting part 42 can be formed by an electrode pattern or a bonding wire which is formed on the printed circuit board 32.

Another electrode of the chip-type capacitor 41 is electrically connected to the ground electrode 39 which is formed on the printed circuit board 32, or another ground electrode pattern.

Also in the antenna unit according to the second embodiment, the mounting structure for the antenna unit can be easily attained by fixing the radiator 31 to the printed circuit board 32 through the feed terminal 34, the ground terminal 35 and the capacitance connecting terminal 37, as hereinabove described. According to this embodiment, the mounting operation for forming the antenna unit can be further simplified since there is no need to form insertion holes in the printed circuit board 32, i.e., the radiator 31 can be surface-mounted on the printed circuit board 32 in the aforementioned manner.

Also according to this embodiment, it is possible to easily attain impedance matching with a peripheral circuit by adjusting the distance between the feed terminal 34 and the ground terminal 35, similarly to the first embodiment. Further, the chip-type capacitor 41 is connected between the capacitance connecting terminal 37 and a ground potential also in this embodiment, whereby it is possible to reduce the resonance frequency of the antenna unit similarly to the first embodiment, thereby facilitating miniaturization of the antenna unit.

While the capacitor connected between the capacitance connecting terminal and the ground potential is formed by the capacitance deriving electrode 25 which is formed in the printed circuit board 19 and the ground electrode pattern 20 which is formed on the lower surface of the printed circuit board 19 in the antenna unit 27 according to the first embodiment, at least one of a capacitance deriving electrode and a ground electrode which is opposed to the capacitance deriving electrode may be built in the printed circuit board 19, as a structure of forming a capacitor utilizing at least a partial layer of the printed circuit board 19. In other words, the capacitance deriving electrode 25 may be formed on the substrate surface of the printed circuit board 19 and a ground electrode which is connected to the ground electrode 20 may be built in the printed circuit board 19, contrarily to the capacitor shown in FIG. 3A. Alternatively, the capacitance deriving electrode 25 may be formed on the upper surface of the printed circuit board 19, to derive electrostatic capacitance between the same and the ground electrode 20. In this case, all portion of the printed circuit substrate 19 along its thickness serves as a dielectric layer for forming a capacitor.

While the embodiment shown in FIG. 6 is provided with the chip-type capacitor 41, the capacitor element is not restricted to such a chip-type capacitor element but may also be formed by a capacitor element provided with a lead terminal. Further, the chip-type capacitor element 41 may be prepared from a proper capacitor element such as a multilayer capacitor.

Figure 7:
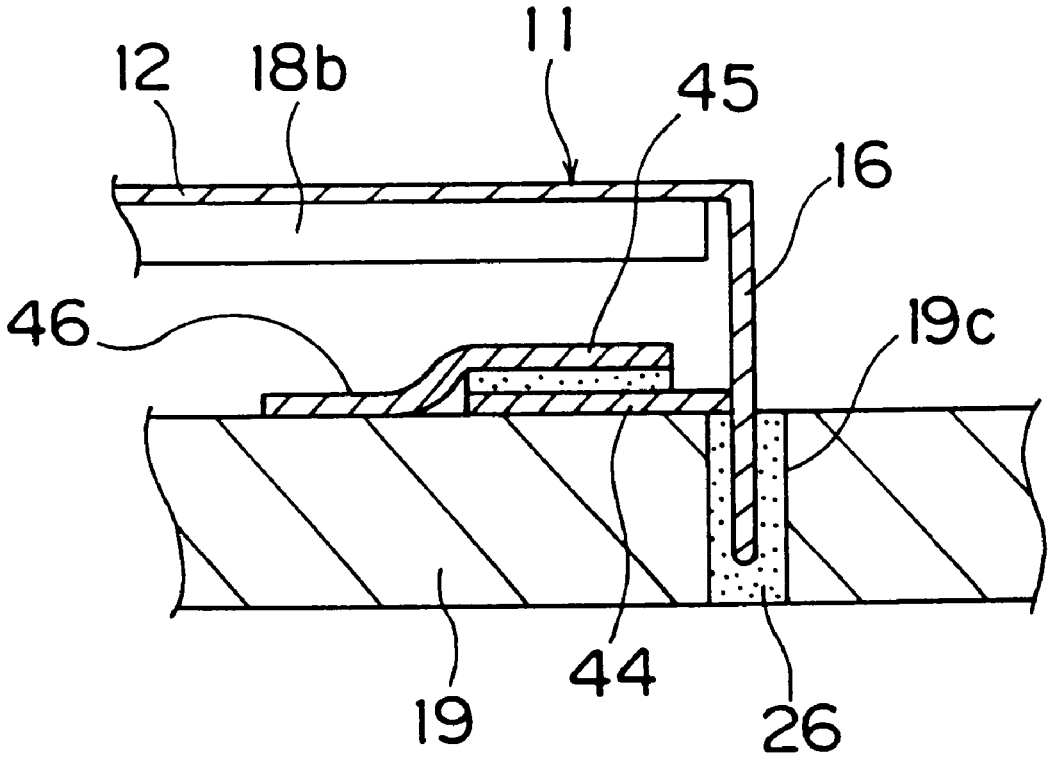
FIG. 7 is a partially enlarged sectional view for illustrating another example of a capacitor.

As shown in FIG. 7, a capacitance deriving electrode 44 which is connected to a capacitance connecting terminal 17 may be formed on an upper surface of a printed circuit board 19, dielectric paste may be printed on the capacitance deriving electrode 44 to form a dielectric layer 45, and a ground electrode 46 which is connected to a ground potential may be formed on the dielectric layer 45 to form a capacitor part. In other words, a conductive material and a dielectric material may be printed on the substrate surface of the printed circuit board 19 by printing, to form a capacitor part.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna unit comprising:

a substrate;

a radiator made of a metal plate and mounted on said substrate, said radiator including:

a flat radiating part having side edges, an open space being disposed between the flat radiating part and said substrate, a feed terminal for feeding the radiating part without using a coaxial feeder, a ground terminal, and an electrostatic capacitance connecting terminal, said feed, ground and connecting terminals also being made from said metal plate and integral with said radiating part and extending integrally from said side edges of said radiating part toward said substrate and soldered directly to conductive electrodes of said substrate; and a capacitance connected between said capacitance connecting terminal and a ground potential, said capacitance comprising a capacitance formed between a capacitance plate, partial layer of said substrate comprising a dielectric layer of said capacitance;

said capacitance comprising said capacitance plate and a ground electrode arranged opposed to each other through said at least partial layer of said substrate, said capacitance plate being electrically connected to said capacitance connecting terminal, said ground electrode being formed on a major surface of said substrate opposite to the surface provided with said radiator, and further wherein said flat radiating part is formed substantially in the shape of a plane rectangle, and said side edges are formed on opposed, shorter sides of said plane rectangular radiating part.

2. An antenna unit in accordance with claim 1, wherein said substrate has a plurality of terminal insertion holes, said feed terminal, said ground terminal and said capacitance connecting terminal being inserted in respective said terminal insertion holes thereby fixing said radiator to said substrate.

3. An antenna unit in accordance with claim 1, further comprising a feed electrode, a ground electrode and an electrode land being formed on said substrate, forward ends of said feed terminal, said ground terminal and said capacitance connecting terminal being provided with bonding parts being bent in parallel with a surface of said substrate respectively, said bonding parts of said feed terminal, said ground terminal and said capacitance connecting terminal being bonded to said feed electrode, said ground electrode and said electrode land respectively.

4. An antenna unit in accordance with claim 1, wherein said metal plate is copper or a copper alloy.

5. An antenna unit comprising:

a substrate:

a radiator made of a metal plate and mounted on said substrate, said radiator having no coaxial feed and including:

a flat radiating part having side edges, an open space being disposed between the flat radiating part and said substrate, a feed terminal, a ground terminal, and an electrostatic capacitance connecting terminal, said feed, ground and connecting terminals also being made from said metal plate and integral with said radiating part and extending integrally from said side edges of said radiating part toward said substrate and attached to said substrate; and a capacitance connected between said capacitance connecting terminal and a ground potential, said capacitance comprising a capacitance formed between a capacitance plate disposed on said substrate and said ground potential, said capacitance comprising said capacitance plate comprising a capacitance deriving electrode form on one major surface of said substrate, a dielectric layer being stacked on said capacitance deriving electrode, and a ground electrode formed opposed to said capacitance deriving electrode through said dielectric layer, and further wherein said flat radiating part is formed substantially in the shape of a plane rectangle, and said side edges are formed on opposed, shorter sides of said plane rectangular radiating part.

6. An antenna unit in accordance with claim 5 wherein said substrate has a plurality of terminal insertion holes, said feed terminal, said ground terminal and said capacitance connecting terminal being inserted in respective said terminal insertion holes thereby fixing said radiator to said substrate.

7. An antenna unit in accordance with claim 5, further comprising a feed electrode, a ground electrode and an electrode land formed on said substrate, forward ends of said feed terminal, said ground terminal and said capacitance connecting terminal being provided with bonding parts being bent in parallel with a surface of said substrate respectively, said bonding parts of said feed terminal, said ground terminal and said capacitance connecting terminal being bonded to the said feed electrode, said ground electrode and said electrode land respectively.

8. An antenna unit in accordance with claim 5, wherein said metal plate is copper or a copper alloy.

9. An antenna unit comprising:

a substrate having an upper surface and a lower surface, a feed electrode being disposed on the upper surface and a ground electrode being disposed on the lower surface;

a radiator made of a metal plate and mounted on the upper surface of said substrate, said radiator including:

a flat radiating part having side edges, an open space being disposed between the flat radiating part and said substrate, a feed terminal, a ground terminal, and an electrostatic capacitance connecting terminal, said fee, ground, and connecting terminals also being made from said metal plate and integral with said radiating part and extending integrally from said side edges of said radiating part toward said substrate to be attached to said substrate, the feed and ground terminals being soldered directly to the feed and ground electrodes, respectively; and a capacitor comprising a capacitance plate formed in said substrate and a ground plate formed on said substrate, said capacitor being coupled between said capacitance connecting terminal and a ground potential, and further said flat radiating part is formed substantially in the shape of a plane rectangle, and said side edges are formed on opposed, shorter sides of said plane rectangular radiating part.

10. An antenna unit comprising:

a dielectric substrate;

radiator mounted on said substrate and composed of a metal plate including:

a flat radiating part having an inductance $L_1$ and first and second ends, an open space being disposed between the flat radiating part and said substrate;

a first bent part disposed on the first end, the first bent part having an inductance $L_2$ and including a feed terminal and a ground terminal, the feed terminal and the ground terminal being separated along the bent part by a distance; and a second bent part disposed on the second end, the second bent part including an electrostatic capacitance connecting terminal; and a separate capacitor connected between said capacitance connecting terminal and a ground potential, wherein a ratio between the inductances $L_1$ and $L_2$ is adjustable by varying the distance between the feed terminal and the ground terminal during manufacture.

11. The antenna unit of claim 10, wherein said flat radiating part is formed substantially in the shape of a plane rectangle, and side edges are formed on opposed, shorter sides of said plane rectangle radiating part.

* * * * *